United States Patent [19]

Wick

[11] Patent Number: 4,685,411

[45] Date of Patent: Aug. 11, 1987

[54] HATCH FOR A BOAT

[75] Inventor: Cyril Wick, London, England

[73] Assignee: Topshore Limited, London, England

[21] Appl. No.: 803,138

[22] PCT Filed: Mar. 15, 1985

[86] PCT No.: PCT/GB85/00103

§ 371 Date: Nov. 14, 1985

§ 102(e) Date: Nov. 14, 1985

[87] PCT Pub. No.: WO85/04140

PCT Pub. Date: Sep. 26, 1985

[30] Foreign Application Priority Data

Mar. 16, 1984 [GB] United Kingdom ..... 8406994

[51] Int. Cl.[4] ..... B63B 19/18

[52] U.S. Cl. ..... 114/202; 114/71

[58] Field of Search ..... 114/71, 201 R, 201 A, 114/202, 203, 204, 361; 49/212; 296/173, 174

[56] References Cited

U.S. PATENT DOCUMENTS

| | | | |
|---|---|---|---|
| 282,100 | 7/1883 | McIntyre | 114/202 |
| 2,308,109 | 1/1943 | Rundquist | 114/361 |
| 3,069,731 | 12/1962 | Gibson | 49/212 |
| 3,161,895 | 12/1964 | Lewis | 114/361 |
| 3,805,724 | 4/1974 | Butler | 114/71 |

FOREIGN PATENT DOCUMENTS

| | | |
|---|---|---|
| 533032 | 3/1973 | Canada . |
| 1781167 | 9/1970 | Fed. Rep. of Germany . |
| 2497733 | 7/1982 | France . |
| 1108432 | 4/1968 | United Kingdom . |

*Primary Examiner*—Joseph F. Peters, Jr.
*Assistant Examiner*—Jesûs D. Sotelo
*Attorney, Agent, or Firm*—McAulay, Fields, Fisher, Goldstein & Nissen

[57] ABSTRACT

A boat includes a hatch assembly for closing an opening in the coach roof of the boat. The hatch assembly includes a roof part which is movable between a first position in which the opening is open and a second position in which the opening is closed. Additionally, the roof part is movable to a third position above and substantially in alignment with the second position. Front and side walls are provided between the roof part and the coach roof when the roof part is in the third position to substantially enclose the opening in the coach roof.

9 Claims, 7 Drawing Figures

HATCH FOR A BOAT

TECHNICAL FIELD

The present invention relates to a hatch for a boat, in particular for a sailing yacht.

BACKGROUND ART

Access between the deck and the cabin area of a sailing boat is conventionally provided by a companion way comprising an opeing in the rear wall of the cabin and an opening in the top of the cabin, i.e. the coach roof. The opening in the cabin wall is generally closed by slotting in a number of washboards. The opening in the approximately horizontal plane of the coach roof is closed by a hatch which slides rearwardly from beneath a hatch-cover.

This arrangement is illustrated in the perspective view of FIG. 1. The washboards are designated by the numeral 1, the hatch by 2 and the hatch-cover by 3.

In fine weather the helmsman steers from the cockpit aft of the boat or amidships with a view over and around the cabin. However, in bad weather, the helmsman will try to take shelter, but without loss of visibility. He must stay in a position from which he can see forward to where the boat is heading and from which he can see approaching seas and other boats. It is known for a collapsible sprayhood, which can be erected in bad weather, to be arranged in front of and above the hatch. Thus, the helmsman can stand or crouch in the cockpit or cabin access area and be partially protected by the sprayhood while steering the boat. However, visibility through the sprayhood tends to be very poor since it is usually composed of a plastics material and has no windscreen wiping device. This means that the helmsman frequently has to peer around or over the hood and thus nonetheless expose himself to the elements. The collapsible sprayhood, when folded down in good weather, is in anycase rather unsightly and care must be taken not to trip over it.

Another solution is for the helmsman to be positioned as far aft and as high as possible so as to be able to see over and around the cabin top. This tends to be very cold and wet for the helmsman and can be dangerous, even when the helmsman is harnessed.

Although there have recently been improvements in protective clothing, bad weather has generally restricted sailing to a period of from Easter to September, or even less in Northern countries.

To meet the problem of sailing in bad weather, some boats are constructed with a permanent doghouse which provides a shelter from which the helmsman can see forwards and steer. However, the doghouse inevitably protrudes well above the rest of the boat and so destroys the smooth flush lines of the boat which are desirable for aesthetic reasons and for keeping the wind resistance as low as possible. Alternatively, the problem is met by so-called "motorsailors" which have a high cabin area complete with steering controls. However, the performance of such motorsailors is considerably poorer than ordinary sailing boats of the same sail area and water-line length, and motorsailors are far from being streamlined.

Thus, the sailor has to choose between a relatively unprotected boat having flush lines and a high or ugly boat which can be sailed in most kinds of weather and thus, if desired, all year round. Hitherto, there has been no satisfactory solution to this problem There is also known a transparent hatch which is hinged at its front end and so tilts upwardly, rather than sliding to open the coach roof opening. This hatch provides only minimal protection and is an obstacle whenever it is raised to open the companion way.

DISCLOSURE OF INVENTION

According to the invention there is provided a boat comprising a hatch assembly for an opening in the coach roof of the boat, the hatch assembly comprising a roof part which is movable between a first position in which the opening is open and a second position in which the opening is closed, wherein the roof part is movable to a third position above the second position, and wherein front and side walls are provided between the roof part and the coach roof when the roof part is in its third position.

The front wall may be pivotally connected to the roof part so that it either folds beneath the roof part or extends forwardly from it, when the roof part is in the first or second position, and the side walls may be slidably arranged beneath the hatch. In the third position of the roof part, the walls suspend from the roof part and engage the surface of the coach roof.

It will be appreciated that the invention concerns a hatch which can be converted at will into a doghouse, wheel-house or pilot-house.

The invention has the great advantage of allowing a boat to have a hatch which looks and operates substantially like a conventional hatch, to have in bad weather the visibility and protection substantially equivalent to that of a permanent doghouse, to have in fine weather the clean flush lines of a boat with no doghouse, and to avoid the need for an unsightly sprayhood.

The walls are transparent over a large part of their area so that the helmsman can have a clear view all around while being protected in bad weather.

Embodiments of the invention are described in detail below, by example only,

BEST MODE OF CARRYING OUT INVENTION

Figure 1:
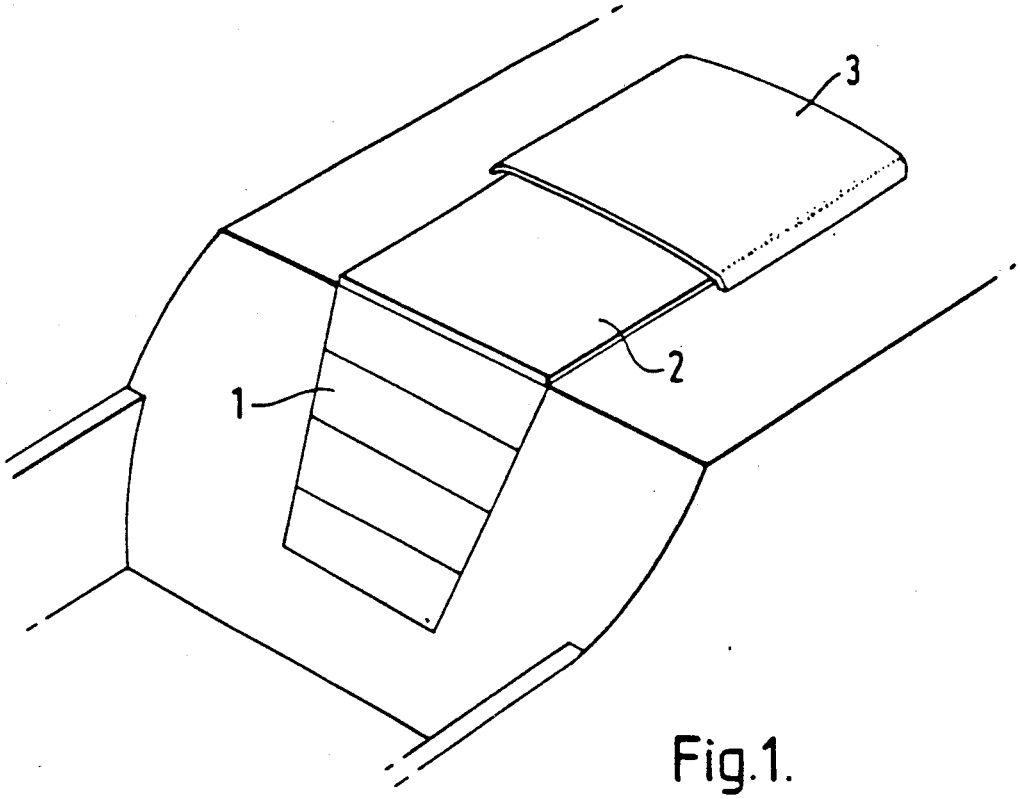
Fig.1. PRIOR ART
FIG. 1 is a schematic perspective view of part of a conventional boat.

As discussed above, FIG. 1 shows part of a conventional boat having the companion way to the cabin area closed in an approximately vertical plane by washboards 1 and in an approximately horizontal plane by a hatch 2 slidable from beneath hatch-cover 3.

Figure 2:
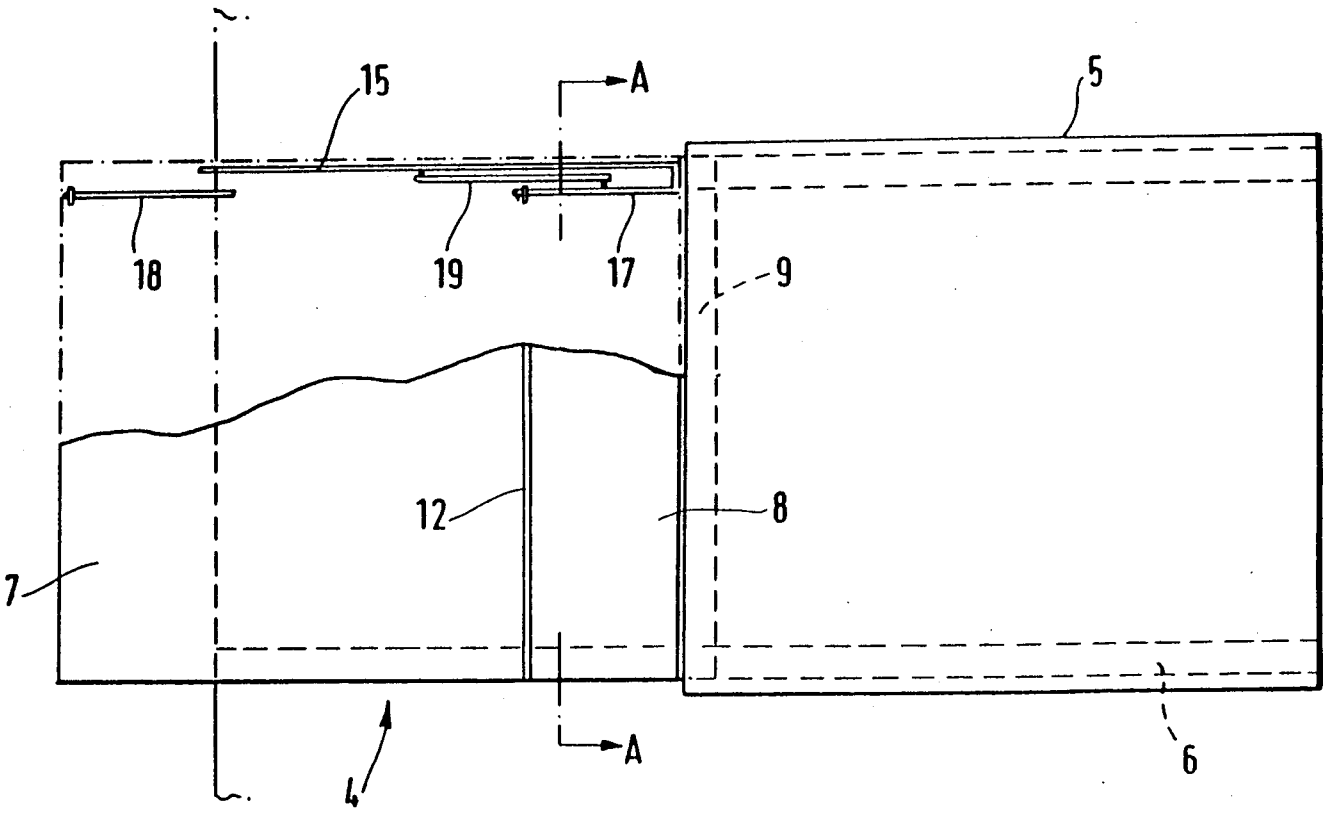
FIG. 2 is a plan view of the hatch assembly of the invention with the roof part substantially at its second position, the roof part being partly cut away.
Figure 3:
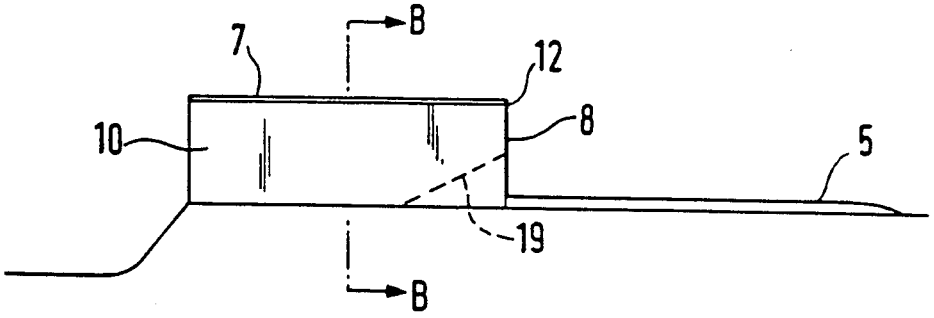
FIG. 3 is an elevation of the hatch assembly with the roof part in its third position.

Referring to FIGS. 2, 3, 4 and 5, the construction of the hatch assembly will be described. FIGS. 2 and 3 show hatch assembly 4 comprising a roof part 7 and front wall 8 extending from the front of the roof part 7.

Figure 4:
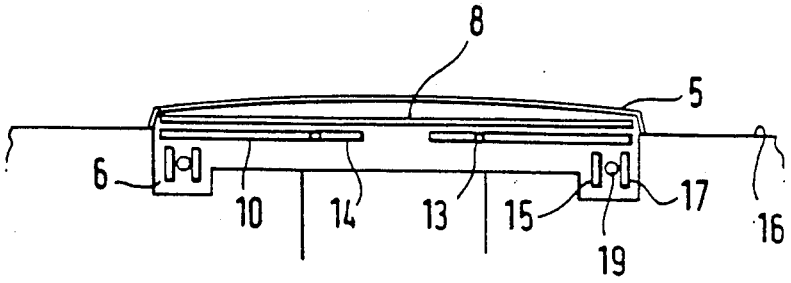
FIG. 4 is a schematic sectional view along line A—A of FIG. 2.

In the first/second positions of the roof part 7, the roof part 7 and front wall 8 lie in the same plane. As seen in FIG. 4, side walls 10 are arranged beneath the roof part 7, when the roof part 7 is in its first and second positions, to lie in a plane approximately parallel to the plane of the roof part 7.

The front wall 8 is pivotally attached at one end to the roof part 7 by hinge 12 and at the other end to support web 9. The side walls 10 are arranged slidably beneath the roof part 7. The side walls 10 include hinges 13 and inner flanges 14. The side walls may be provided with catches which lock with locking points on the coach roof, and with rubber seals along either edges to provide water-tight connections with the front wall and with the coach roof.

Each of the walls comprise a frame and a transparent area, which transparent area covers most of the area of the wall to provide maximum visibility. The transparent area is composed of, for example, glass or Perspex.

As is most clearly shown in FIGS. 2 and 4, the hatch assembly 4 includes runners 15 on either side thereof which slide along channels 6. Low friction materials may be used between the runners 15 and the channels 6. Forward and rear struts 17 and 18 re pivotally connected between runners 15 and the roof part 7. Struts 17 may form part of the frame of front wall 8. A telescopic gas-pressurised strut 19 is connected between a point along each runner 15 and each forward strut 17.

Figure 6:
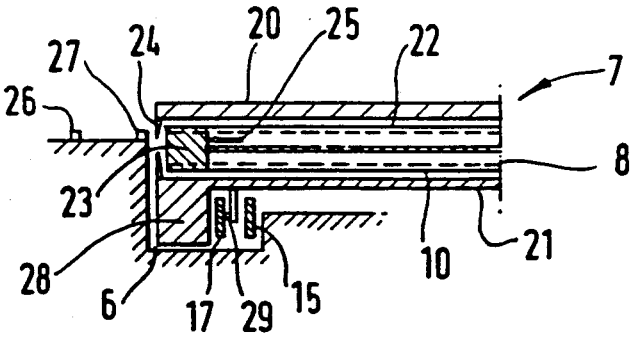
FIG. 6 is a sectional view of a detail of the boat and hatch assembly of the invention.

FIG. 6 shows a detail of one embodiment, and corresponds to a partial view of FIG. 4. Roof part 7 comprises upper and lower panels 20 and 21 connected together to form an envelope. The side wall 10 slides within the envelope, tongues of the panels 20, 21 engaging in grooves 22 in the frame 23 of the side wall.

The gap at the side edges of the roof part 7 out of which side wall 10 slides is sealed with rubber strips 24. Catch 25 is connected to frame 23 for locking engagement with lug 26 when the roof part 7 is raised and the side wall is pulled out and dropped to rest against lip 27 of the coach roof.

Lower panel 21 has an outer flange 28 which slides in channel 6. Channel 6 may be formed in the coach roof itself or may, for example, be formed in a strip of wood attached to the coach roof.

The forward strut 17 has a pivotal connection 29 witht he forward end of lower panel 21. Strut 17 is also pivotally connected to runner 15 and gas-actuated strut 19 is connected between strut 17 and runner 15, but this is not illustrated in FIG. 6. In this embodiment, runner 15 is on the inside of struts 17 and 18.

A retaining catch (not shown) must also be provided to prevent the hatch from lifting when it is simply sliding forward and backward to close and open the companion way.

The sequence of movements of the roof part of the hatch assembly between its various positions will now be described. In its first position, the hatch assembly including roof part 7 is positioned forwardly, beneath the hatch-cover 5. To reach its second position, the hatch assembly is slid rearwardly along the channels 6, like a conventional hatch, to close the opening in in the coach roof. In this position, the front wall 8 still lies beneath the hatch-cover 5 since the roof 7 is the same length as the opening in the coach roof. To reach its third position, the hatch assembly is pulled further backwards to the position shown in FIG. 2 wherein the front wall reaches a predetermined jacking position clear of the hatch cover 5. In this jacking position, the support web 9 on which the front wall 8 is hinged remains beneath the hatch cover 5. The hatch assembly is then pushed forwardly and upwardly and the gas strut 19 is actuated to force the struts 17 to rotate clockwise and lift the roof of the hatch. The rear struts 18 are also raised by this action. The struts 17 and 18 lock when they reach the vertical position. The front wall 8 follows the movement of struts 17 to assume a vertical position and provide the front window of the temporary doghouse.

Then the side walls 10 are pulled out by hand and dropped into position. Flanges 14 move to a predetermined position at the edge of roof part 7. The side and front walls are then locked in a water-tight manner with each other and the side walls are locked with the coach roof 16.

The front wall 8 may include side flanges which engage with the side walls 10 when the temporary doghouse is erected. The flanges are needed since the side walls 10 which slide within the roof 7 will be slightly shorter than the roof part 7.

Figure 5:
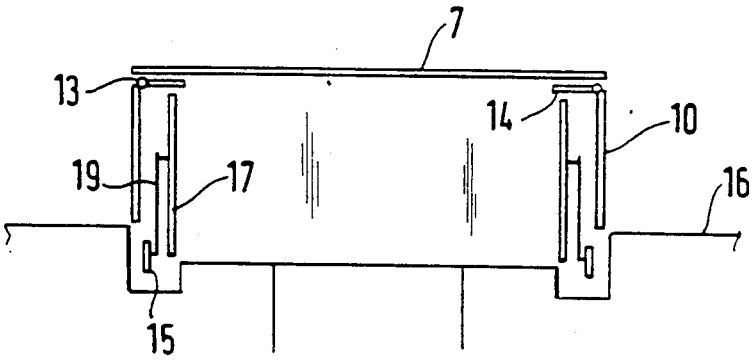
FIG. 5 is a schematic sectional view along line B—B of FIG. 3.

It will be noted, in particular from FIG. 5, that the hatch assembly is substantially wider than the companion way to the cabin area. This means that when the doghouse is erected the helmsman has greater visibility while being protected from the elements.

Variations on the described embodiment will be apparent to those skilled in the art. The following variations are mentioned as examples only.

The hatch assembly may have an intermediate position between the second and third positions so that the wind resistance can be reduced in bad weather and provide greater protection to the helmsman.

Figure 7:
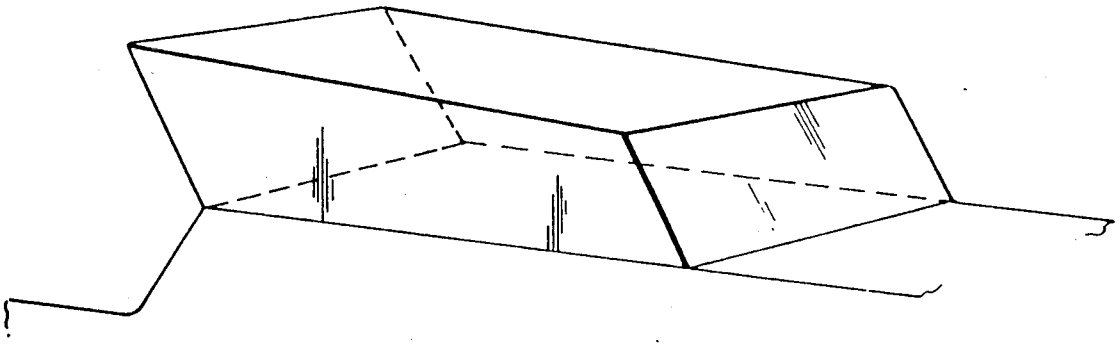
FIG. 7 shows a further embodiment of the invention.

The struts 17 and/or the front wall may most preferably assume positions other than vertical when the hatch assembly is in the third position, provided that the side walls 10 are shaped appropriately, and the roof part 7 need not be horizontal when raised. One embodiment of the invention having a sloping roof and front window is illustrated in FIG. 7. Clearly, if the bottom of the side walls is longer than the roof part, then sliding or hinged quarterlights will have to be provided for the side walls.

It is not expected that the front wall would include from the vertical at an angle of more than 40° either way or tht the side walls would incline from the vertical at an angle ofmore than 30° inwardly. The roof might rise rearwardly at an angle of up to 20°. Thus the front wall might be at an angle of from 50° to 150° to the roof and the side walls might be at an angle of from 90° to 120° to the roof, when the doghouse is raised.

The front wall may fold underneath the roof 7, or may be slidable from beneath the roof part 7 as the side walls are; on the other hand, the side walls 10 may simply hinge from the roof 7.

If the roof part is as wide as it is long, the side walls may be pivotally attached to the front wall.

A rear wall may be provided to create a more enclosed doghouse, the rear wall being attached to the roof part in a similar fashion to the front or side walls.

As long as struts are provided, then the walls to the doghouse may be separate panels, fitted after the roof part has been raised, or the walls may slide from the coach roof or the sides of the cabin and then be lifted in to position.

Other raising mechanisms, apart from gas-actuated struts, may also be adopted. For example the raising may be purely a manual operation.

Castors may be provided on the runners 15 to make the hatch easier to slide.

The roof of the hatch may be made transparent to provide better lighting to the doghouse and to the cabin area and to see the set of the sails.

The side walls may be caused to slide from the roof part by means of a crank mechanism.

The roof part 7 and the hatch-cover 5 may be curved rather than flat.

Windscreen wiping devices can be fitted on the walls.

A second set of steering and power controls may be provided next to the companion way, protected by the doghouse when it is raised.

A reserve, standard hatch may also be provided beneath the hatch cover, which reserve hatch can be slid forward in an emergency if the raised hatch assembly of the invention were swept away in heavy seas.

The components of the hatch assembly might preferably utilize corrosion and/or abrasion resistant steels or alloys to which specific coatings, such as sold under the Registered trade marks INTERCHROME and INTERNAL, have been applied. Alternatively, conventional anodised aluminium may be used.

The side walls may also be formed of transparent sheets of soft, foldable plastic or a canvas. These flexible panels can be separate parts fitted to the boat after the roof part is raised, or may fold beneath the roof part when it is in its first and second position and be folded down when it is raised to its third position. The flexible panels can be fitted using "velcro" or by means of snap-on fasteners.

To improve the lines of the boat, the side walls may flare out from the front wall. This means that the roof part may be trapezoidal in shape, though the opening in the coach roof can remain rectangular, with the runners still being parallel.

What is claimed is:

1. A boat comprising a hatch assembly for an opening in the coach roof of the boat, the hatch assembly comprising a roof part which is movable between a first position in which the opening is open and a second position in which the opening is closed, wherein the roof part is movable to a third position above and substantially in alignment with the second position, and wherein front and side walls are provided between the roof part and the coach roof when the roof part is in its third position.

2. A boat according to claim 1, wherein the front wall is pivotally connected to the roof part so that it can either fold beneath the roof part or extend forwardly from it.

3. A boat according to claim 1, wherein the side walls are slidably arranged beneath the hatch.

4. A boat according to claim 2, wherein the side walls are separate panels fitted to the roof part and coach roof after the roof part is moved to its third position.

5. A boat according to claim 4, wherein the side walls are flexible panels.

6. A boat according to claim 1, wherein the side walls fold beneath the roof part.

7. A boat according to claim 6, wherein the side walls are flexible panels.

8. A boat according to claim 1, wherein the roof part is wider than the opening in the coach roof.

9. A boat according to claim 8, wherein the side walls are further apart at the back than at the front when the roof part is raised.

* * * * *